US006347818B1

(12) United States Patent
Lyons, Sr.

(10) Patent No.: US 6,347,818 B1
(45) Date of Patent: Feb. 19, 2002

(54) HOLD OPEN ARM ASSEMBLY

(75) Inventor: Robert J. Lyons, Sr., Hamden, CT (US)

(73) Assignee: The Bilco Company, West Haven, CT (US)

( * ) Notice: Subject to any disclaimer, the term of this patent is extended or adjusted under 35 U.S.C. 154(b) by 0 days.

(21) Appl. No.: 09/629,914

(22) Filed: Jul. 31, 2000

(51) Int. Cl.[7] ..... E05C 17/04; E05C 17/44

(52) U.S. Cl. ..... 292/271; 292/338; 16/360; 16/361; 49/187; 49/386

(58) Field of Search ..... 292/271, 272, 292/274, 277, 262, 256.5, DIG. 17, 338; 16/357, 360, 361; 49/213, 216, 187, 190, 407, 386

(56) References Cited

U.S. PATENT DOCUMENTS

| | | | | | |
|---|---|---|---|---|---|
| 1,081,707 | A | * | 12/1913 | Valentine | 292/271 |
| 2,193,112 | A | * | 3/1940 | Peterson | 292/272 |
| 2,249,403 | A | * | 7/1941 | Stollsteimer | 16/357 |
| 2,823,662 | A | * | 2/1958 | Aylor | 16/361 |
| 2,939,738 | A | | 6/1960 | Lyons | |
| 2,994,556 | A | * | 8/1961 | Sewelin et al. | 292/272 |
| 4,145,843 | A | | 3/1979 | Lyons | |
| 4,522,528 | A | * | 6/1985 | Bewers | 16/360 |
| 4,995,143 | A | * | 2/1991 | Demura et al. | 16/357 |
| 5,040,269 | A | | 8/1991 | Lyons, Jr. | |
| 5,136,811 | A | | 8/1992 | Lyons, Sr. | |
| 5,205,073 | A | | 4/1993 | Lyons, Sr. | |
| 5,301,469 | A | | 4/1994 | Lyons, Sr. | |
| 5,373,665 | A | | 12/1994 | Lyons, Sr. | |
| 5,554,433 | A | | 9/1996 | Perrone, Jr. et al. | |
| 5,565,274 | A | | 10/1996 | Perrone, Jr. et al. | |
| 5,927,012 | A | | 7/1999 | Cermola et al. | |
| 6,021,606 | A | | 2/2000 | Kos | |
| 6,041,553 | A | | 3/2000 | Joyce et al. | |

* cited by examiner

*Primary Examiner*—Douglas C. Butler
*Assistant Examiner*—Robert A. Siconolfi
(74) *Attorney, Agent, or Firm*—DeLio & Peterson, LLC

(57) ABSTRACT

A hold open arm assembly for a non-vertically hinged door prevents a door for a roof or floor opening from closing unexpectedly and allows one-handed operation. The assembly includes an elongated arm that bears directly against a stop aligned with the axis of the arm when a closing force, such as a wind load, is applied directly to the door. The arm has a guide that engages a guide slot in a bracket attached to the door. The guide slot is tapered and widens near the stop. When a closing force is applied to a handle connected to the arm, the guide moves parallel to the guide slot and the arm clears the stop, allowing the door to close. When the closing force is applied to the door, and not the handle, the guide moves perpendicular to the guide slot so that the arm engages the stop. The guide is provided with a low friction roller bearing for smooth operation.

20 Claims, 3 Drawing Sheets

HOLD OPEN ARM ASSEMBLY

BACKGROUND OF THE INVENTION

1. Field of the Invention

The present invention relates to devices for holding open hinged doors and covers of the type used for openings in roofs and floors.

2. Description of Related Art

Hatch covers, roof scuttles, floor doors and other types of openings in roofs and floors are provided with doors or covers that are hinged horizontally or at some angle to the vertical. The doors are typically heavy in order to support snow loads or traffic on their upper surface. Because such doors are heavy, and because the non-vertical hinging of the door would cause the heavy door to rapidly swing closed when released, all such doors need hold open arm assemblies to hold them open.

For safety, most such doors are counterbalanced, but even fully counterbalanced doors are usually provided with a hold open arm assembly. The hold open arm assembly prevents the door from suddenly closing-for example under the influence of a sudden wind gust, or by someone leaning or falling against the door. Another advantage of modern hold open assemblies for counterbalanced doors is that they can be operated to close the door with a single hand. This is an important safety feature for entry and exit openings having a ladder below the opening. Anyone climbing through the opening, to or from the ladder, must have one hand free to hold onto the ladder or railing to avoid a fall.

Prior art hold open arm assemblies have used a hold open arm with a perpendicularly protruding guide engaged in an elongated guide slot located in an arm guide bracket attached to the door. One end of the arm is hinged to the frame, and the guide, at the opposite end, slides in the guide slot. The guide slot has a width that matches the diameter of the guide and a notch at one end. When the door is opened, the guide drops into the notch to hold the door in the open position. A handle on the arm allows the user to swing the arm and pull the guide out of the locking notch. The guide moves along the guide slot and guides the door to the closed position.

Although hold open arm designs of the type described have been quite successful, one difficulty has been that the guide has served both the guiding function (to control the motion of the arm relative to the door) and the locking function (to prevent the door from closing unexpectedly). It has been difficult to design a guide with suitable properties for performing both functions. The load on the door can be quite high, particularly when the guide is preventing the door from closing under the unexpected application of a closing force. Thus, the guide is usually constructed of a material such as steel. This results in metal to metal contact between the guide and the guide slot. For smooth operation, it is preferred to eliminate this metal to metal contact.

Another disadvantage of earlier designs resides in the fact that the guide is offset from the longitudinal axis of the arm in order to engage the guiding slot. This offset means that when the guide is used to prevent the door from closing, the force resisting the closing force is also applied at a point offset from the longitudinal axis of the arm. This offset force application produces a significant bending moment on the arm when a large closing force is applied to the door. The resulting load on the guide may tend to damage the guide or bend the arm.

It is therefore an object of the present invention to provide a hold open arm assembly that has a smooth relatively frictionless operation, and yet which is extremely strong and resistant to closing forces applied directly to the door.

Still other objects and advantages of the invention will in part be obvious and will in part be apparent from the specification.

SUMMARY OF THE INVENTION

The above and other objects, which will be apparent to those skilled in art, are achieved in the present invention which is directed to a hold open arm assembly for a non-vertically hinged door that includes an elongated arm having first and second ends, a handle attached to the arm for moving the door from an open position to a closed position, an arm guide bracket having a guide slot formed therein and a guide mounted to the second end of the arm and extending outward from the arm axis into guiding engagement with the guide slot. The first end of the arm is adapted for pivotal connection to a mounting surface and the second end has a stop surface thereon.

The arm guide bracket is mounted to the door and the guide slot defines a guide slot plane offset from the arm axis. A stop is mounted offset from the guide slot plane in approximate alignment with the arm axis when the door is in the open position. The stop contacts the stop surface on the arm and prevents motion of the door from the open to the closed position when a closing force is applied directly to the door.

The guide slot is preferably tapered to securely hold the guide at one end when the door is closed and allows motion of the guide perpendicular to the axis of the guide slot when the door is open. The perpendicular motion causes the stop to move into and out of engagement with the stop surface of the arm.

The stop surface is oriented at least ninety degrees relative to the guide slot axis. A bearing on the guide provides rolling contact between the guide and the guide slot. The bearing is non-metallic, preferably a tough plastic material such as nylon.

The guide may be a bolt extending perpendicular to the arm axis, with the bearing being mounted thereon. The stop may be a part of the guide bracket, comprising a tab bent perpendicular to the guide slot plane. To strengthen the arm, it may be stamped with a lengthwise strengthening ridge, substantially aligned with the arm axis.

BRIEF DESCRIPTION OF THE DRAWINGS

The features of the invention believed to be novel and the elements characteristic of the invention are set forth with particularly in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 3 is drawn at the same enlarged scale as FIG. 2, and the handle has been omitted to better show the invention.

DESCRIPTION OF THE PREFERRED EMBODIMENT(S)

In describing the preferred embodiment of the present invention, reference will be made herein to FIGS. 1–4 of the drawings in which like numerals refer to like features of the invention.

Figure 1:
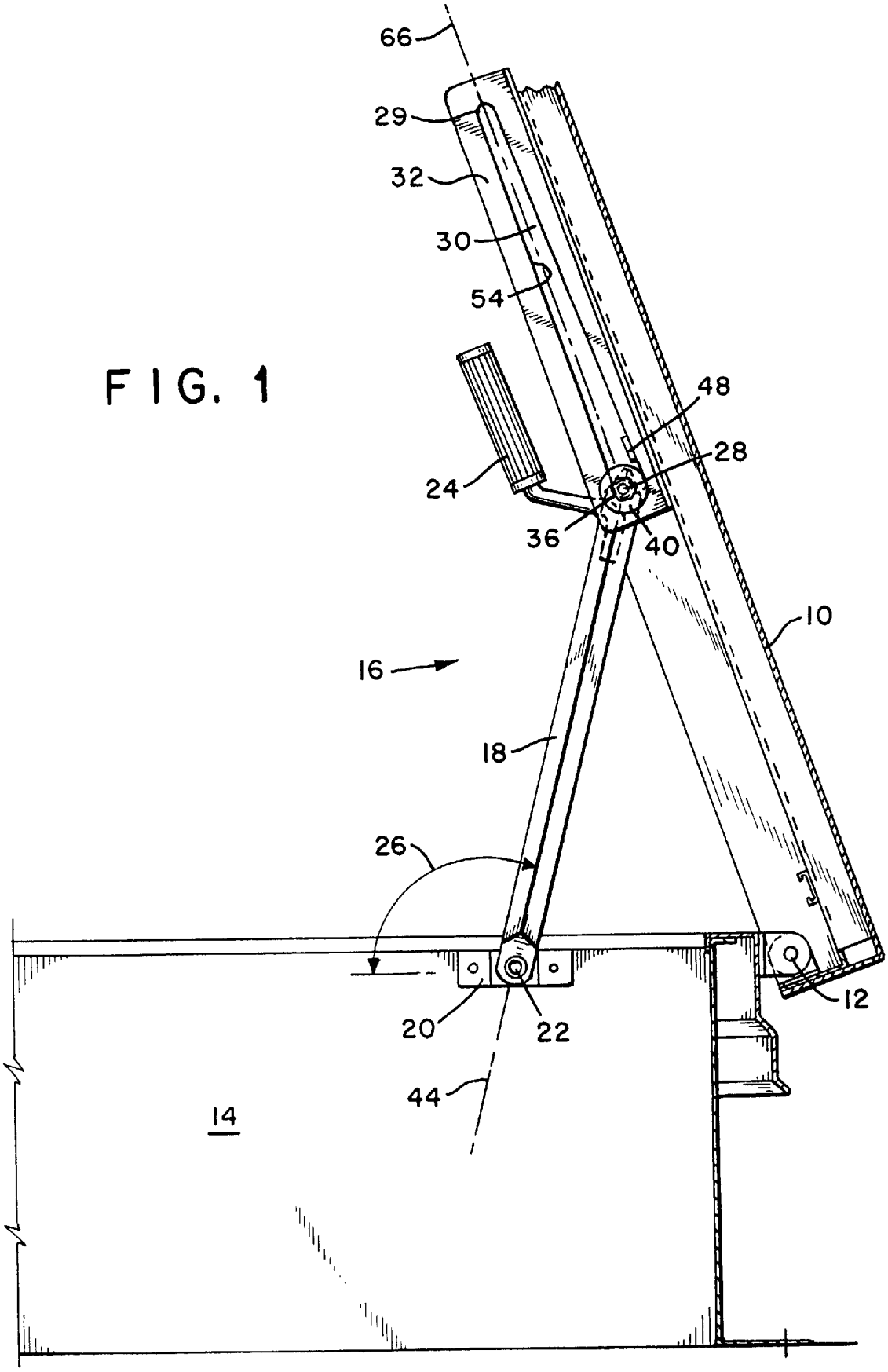
FIG. 1 is a side elevational view of a hold open arm assembly according to the present invention, the hold open arm assembly being shown in combination with a horizontally hinged door, and the view being taken in cross section through the door and associated frame, looking outward from the interior of the frame, to better show the hold open arm assembly.

Referring to FIG. 1, the present invention is designed for installation on a door 10 that is non-vertically hinged on hinge 12 to a frame 14. The door may be a cover for a roof scuttle or any other type of door closing an opening in a roof or floor. The hinge line is usually horizontal, but it may also lie at any other angle to the vertical.

Typically, the door 10 will be counterbalanced with lift springs, torsion rods or other types of known counterbalancing systems. In the most typical application, the door 10 will be over counterbalanced such that there is a slight opening force on the door 10 when it is in the open position illustrated in FIG. 1.

The hold open arm assembly 16 of the present invention includes an elongated arm 18 extending between the door 10 and the frame 14. Arm 18 is pivotally connected to the frame 14 with a pivot mounting bracket 20 and a pivot 22. Handle 24 is attached to the arm 18 for closing and opening the door by swinging the arm 18 about arc 26.

The end of arm 18 opposite pivot 22 includes a guide 28 that projects perpendicularly out from the lengthwise axis defined by elongated arm 18. The guide 28 projects into a guide slot 30 formed in an arm guide bracket 32 mounted to door 10. Guide slot 30 is tapered, having a width at end 29 that is approximately the same as the diameter of the guide 28 and a width at the opposite end that is substantially wider than the diameter of the guide 28.

Figure 3:
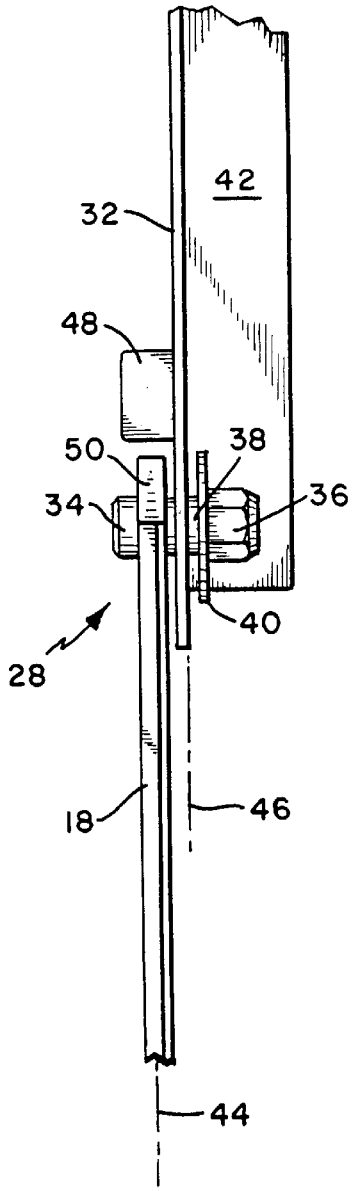
FIG. 3 is a detail front view of the portion of the hold open arm assembly seen in FIG. 2, taken from the direction marked with line 3—3 in FIG. 2.
Figure 2:
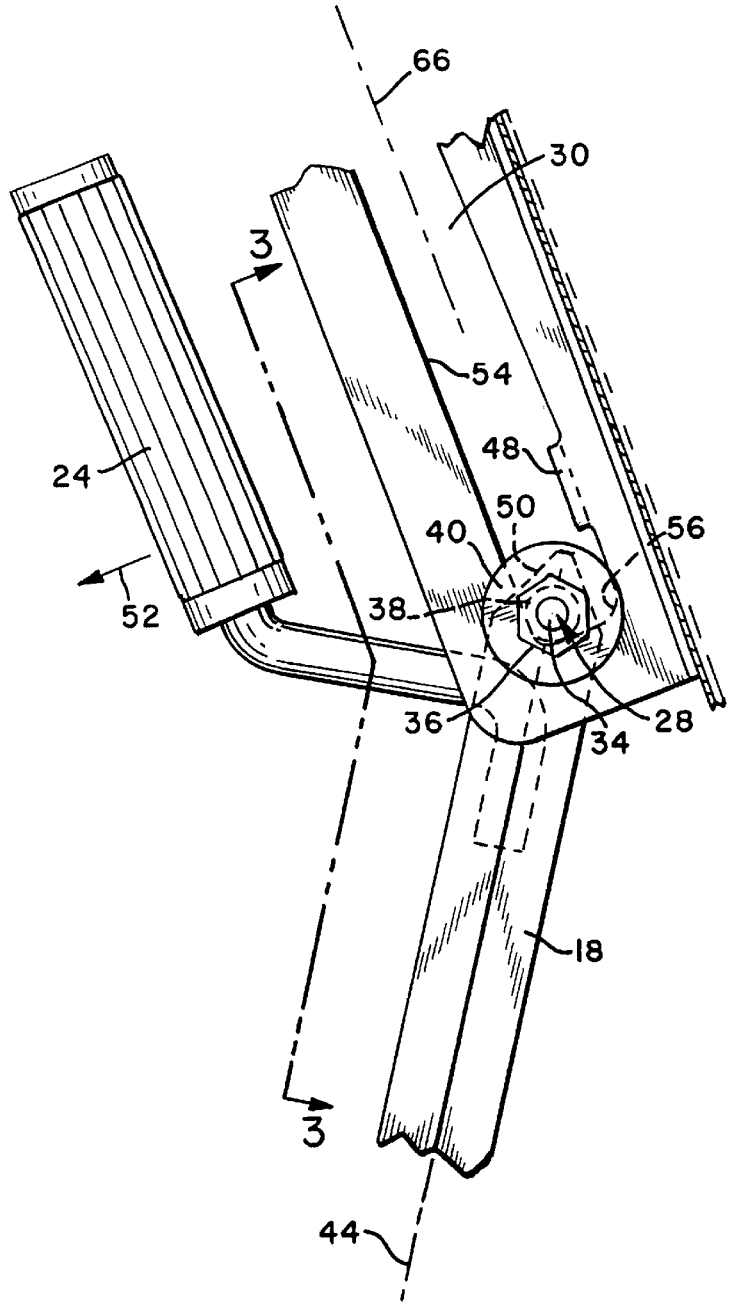
FIG. 2 is a detail side view, at an enlarged scale, of a portion of the hold open arm assembly seen in FIG. 1, showing the relative position of the arm, guide and guide slot when the door is at the maximum open position.

Referring to FIGS. 2 and 3, the guide 28 comprises a headed bolt 34 that is preferably welded al the head to arm 18. A nut 36 holds a roller bearing 38 and a washer 40 on the shaft of the bolt 34. Nut 36 traps the arm guide bracket 32 between the hold open arm 18 and the washer 40. Roller bearing 38 provides a smooth and relatively frictionless rolling contact between the guide 28 and the inner surfaces of guide slot 30 as the door moves between the open and closed positions. The roller bearing 38 is preferably non-metallic, most preferably made of an impact resistant, low friction, tough plastic material, such as nylon. The arm guide bracket 32 includes a flange 42 that attaches the bracket to the bottom surface of door 10.

Referring to FIG. 3, the elongated arm defines an arm axis 44 and the guide slot defines a guide slot plane 46 that is offset from the arm axis 44. This offset between the arm axis and the guide slot plane is conventional, however, instead of using a conventional notch in the guide slot acting against the guide, the present invention uses a stop 48 that is also offset from the guide slot plane 46 and in approximate alignment with the arm axis 44. The stop 48 acts against a stop surface 50 at one end of the arm 18.

This arrangement has numerous advantages. A closing force applied directly to the door is now resisted by a corresponding force applied in line with the arm axis 44 and the arm 18. Bending forces on the arm are significantly reduced or eliminated, resulting in a stronger, more damage-resistant design. Further, the forces are now directly applied between the arm and the stop 48 which is rigidly mounted to the door. Most importantly, this design separates the guiding function of the guide 28 from the stop function, which allows the guide to have a roller bearing for smooth operation without risking damage to that bearing when high closing forces are applied to the door. High forces needed to resist closing are carried between the stop 48 and the arm—bypassing and protecting the guide 28.

Referring to FIG. 2, the position of the guide 28 relative to the guide slot 30 can be seen when the door is in the open position. The door 10 which is shown as an over counterbalanced door pulls the guide 28 and the roller bearing 38 into the lower corner of the guide slot 30. The arm 18 is preventing the door from opening further under the over counterbalancing force. It will be noted that the stop surface 50 at the end of arm 18 is not engaged with stop 48.

The guide slat 30 has a width at this end which is greater than the diameter of the roller bearing 34. This extra width allows the guide 28 and roller bearing 34 to move perpendicular to the guide slot 30, as well as parallel to it as occurs during normal opening and closing of the door. Perpendicular motion of the guide 28 causes the stop surface 50 at the end of arm 18 to engage stop 48. Parallel motion allows the stop surface 50 at the end of arm 18 to move freely past the stop 48.

If a normal closing force is applied by a user to handle 24 in the direction indicated with arrow 52 (see FIG. 2), the guide 28 moves along surface 54 of the guide slot 30, parallel to the guide slot axis 66. However, if a closing force is applied directly to the door, instead of to the handle, the guide 28 rolls perpendicular to the guide slot axis 66 along surface 56 of guide slot 30 and the handle and arm move in the direction opposite to arrow 52. This causes stop surface 50 to move into engagement with stop 48 and the stop force holding the door open is applied substantially along the arm axis 44. Guide 28 and roller bearing 38 do not have to carry the force needed to prevent the door from closing.

Figure 4:
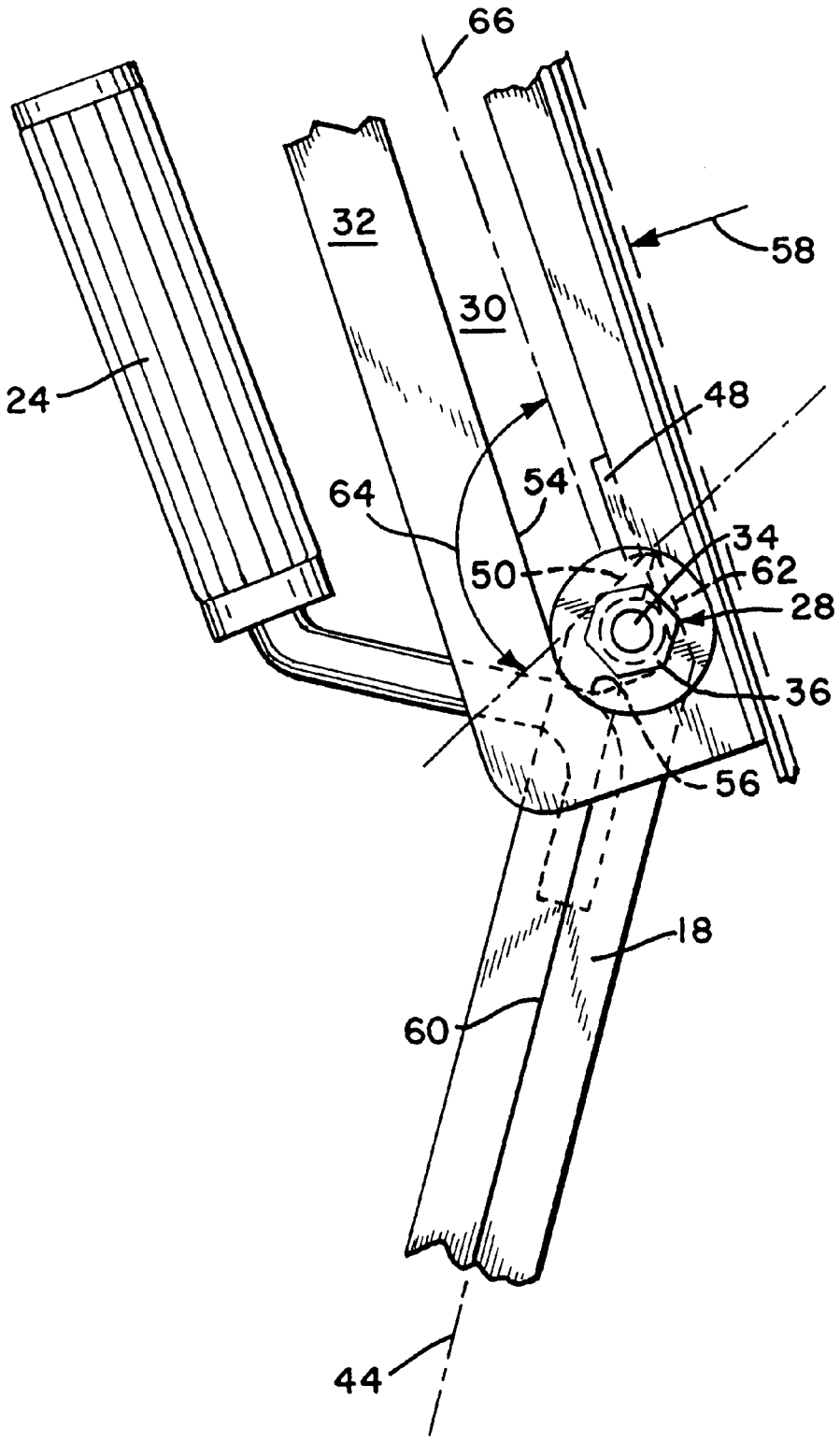
FIG. 4 is a detail side view of the hold open arm assembly corresponding to the view seen in FIG. 2 except that the relative position of the arm, guide and guide slot are illustrated when the door is being prevented from closing as the result of a closing force applied directly to the door.

FIG. 4 illustrates the position of arm 18 and guide 28 relative to the stop 48 and the arm guide bracket 32 when a closing force 58 is being applied directly to the door. To help the arm 18 remain rigid under an applied closing force 58 to the door, arm 18 is provided with a strengthening ridge 60 that it preferably formed by stamping arm 18 to form a slight angle therein. Strengthening ridge 60 is substantially aligned with the arm axis 44.

In the preferred design shown, stop surface 50 comprises one of two inwardly angled surfaces 50, 62. As can be seen in FIG. 4, stop surface 50 forms an angle 64 that is at least ninety degrees, and preferably slightly greater than ninety degrees to the guide slot axis 66.

In the design shown, the stop 48 may be constructed by bending a tab outward from the material used to construct the arm guide bracket. In other designs, particularly those for very heavy doors, such as floor doors, the stop 48 may be a separate block of heavy material which may be welded or bolted into position.

The hold open arm assembly of this invention is most suitable for counterbalanced designs, preferably those with some slight excess of over counterbalancing in the open position, but it can also be used with designs that are under counterbalanced, or not counterbalanced at all.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A hold open arm assembly for a non-vertically hinged door comprising:

an elongated arm having first and second ends, the arm defining an arm axis, the first end of the arm being adapted for pivotal connection to a mounting surface and the second end having a stop surface thereon;

a handle attached to the arm for moving the door from an open position to a closed position;

an arm guide bracket having a guide slot formed therein, the arm guide bracket being adapted for mounting to the door, the guide slot defining a guide slot plane offset from the arm axis;

a guide mounted to the second end of the arm and extending outward from the arm axis into guiding engagement with the guide slot; and a stop mounted offset from the guide slot plane in approximate alignment with the arm axis when the door is in the open position, the stop contacting the stop surface on the arm and preventing motion of the door from the open to the closed position when a closing force is applied directly to the door.

2. The hold open arm assembly of claim 1 wherein the guide slot is tapered.

3. The hold open arm assembly of claim 1 wherein the guide slot defines a guide slot axis and the stop surface forms at least a ninety degree angle relative to the guide slot axis.

4. The hold open arm assembly of claim 1 wherein the guide includes a bearing connected to provide rolling contact between the guide and the guide slot.

5. The hold open arm assembly of claim 4 wherein the bearing comprises a non-metallic bearing.

6. The hold open arm assembly of claim 4 wherein the bearing is formed of nylon.

7. The hold open arm assembly of claim 4 wherein the guide comprises a bolt extending perpendicular to the arm axis, the bolt having the bearing mounted thereon.

8. The hold open arm assembly of claim 1 wherein the stop comprises a tab bent perpendicular to the guide slot plane.

9. The hold open arm assembly of claim 1 wherein the arm includes two inwardly angled surfaces at the second end of the arm, one of the angled surface forming the stop surface.

10. The hold open arm assembly of claim 1 wherein the arm includes a lengthwise strengthening ridge substantially aligned with the arm axis.

11. A hold open arm assembly for a non-vertically hinged door, the door being movable from an open to a closed position and being at least slightly over counterbalanced when at the open position, the hold open arm assembly comprising:

an elongated arm having first and second ends, the arm defining an arm axis, the first end of the arm being adapted for pivotal connection to a mounting surface and the second end having a stop surface thereon;

a handle attached to the arm for moving the door from an open position to a closed position;

an arm guide bracket having a guide slot formed therein, the arm guide bracket being adapted for mounting to the door, the guide slot defining a guide slot plane offset from the arm axis;

a guide mounted to the second end of the arm and extending outward from the arm axis into guiding engagement with the guide slot; and a stop mounted offset from the guide slot plane in approximate alignment with the arm axis when the door is in the open position;

the guide slot having a width greater than a diameter of the guide at an end of the guide slot near the stop, the guide moving parallel to the guide slot when a closing force is applied to the arm with the handle and the guide moving perpendicular to the guide slot when a closing force is applied directly to the door.

12. The hold open arm assembly of claim 11 wherein the guide slot is tapered.

13. The hold open arm assembly of claim 11 wherein the guide slot defines a guide slot axis and the stop surface forms at least a ninety degree angle relative to the guide slot axis.

14. The hold open arm assembly of claim 11 wherein the guide includes a bearing connected to provide rolling contact between the guide and the guide slot.

15. The hold open arm assembly of claim 14 wherein the bearing comprises a non-metallic bearing.

16. The hold open arm assembly of claim 14 wherein the bearing is formed of nylon.

17. The hold open arm assembly of claim 14 wherein the guide comprises a bolt extending perpendicular to the arm axis, the bolt having the bearing mounted thereon.

18. The hold open arm assembly of claim 11 wherein the stop comprises a tab bent perpendicular to the guide slot plane.

19. The hold open arm assembly of claim 11 wherein the arm includes two inwardly angled surfaces at the second end of the arm, one of the angled surface forming the stop surface.

20. The hold open arm assembly of claim 11 wherein the arm includes a lengthwise strengthening ridge substantially aligned with the arm axis.

* * * * *

UNITED STATES PATENT AND TRADEMARK OFFICE

CERTIFICATE OF CORRECTION

PATENT NO. : 6,347,818 B1
DATED : February 19,2002
INVENTOR(S) : Robert J. Lyons, Sr It is certified that error appears in the above-identified patent and that said Letters Patent is hereby corrected as shown below:

Column 4,
Line 21, delete “slat” and substitute therefor -- slot --.

Signed and Sealed this

Eleventh Day of June, 2002

*Attest:*

*Attesting Officer*

JAMES E. ROGAN
*Director of the United States Patent and Trademark Office*